US005595147A

United States Patent [19]

Feuling

[11] Patent Number: 5,595,147

[45] Date of Patent: Jan. 21, 1997

[54] CONTRA-ROTATING TWIN CRANKSHAFT INTERNAL COMBUSTION ENGINE

[76] Inventor: James J. Feuling, 2521 Palma Pl., Ventura, Calif. 93003

[21] Appl. No.: 574,434

[22] Filed: Dec. 15, 1995

[51] Int. Cl.[6] ..... F02B 75/32

[52] U.S. Cl. ..... 123/52.4; 123/59.6; 123/197.1

[58] Field of Search ..... 123/52.4, 53.2, 123/59.6, 197.3, 197.1

[56] References Cited

U.S. PATENT DOCUMENTS

| | | | |
|---|---|---|---|
| 4,505,239 | 3/1985 | Deland | 123/59.6 |
| 4,614,169 | 9/1986 | Figliuzzi | 123/53.2 |
| 4,690,113 | 9/1987 | Deland | 123/59.6 |
| 4,809,646 | 3/1989 | Paul et al. | 123/59.6 |
| 5,058,537 | 10/1991 | Paul et al. | 123/197.3 |

FOREIGN PATENT DOCUMENTS

| | | | |
|---|---|---|---|
| 2431607 | 2/1980 | France | 123/59.6 |
| 57-171001 | 10/1982 | Japan | 123/59.6 |

*Primary Examiner*—David A. Okonsky
*Attorney, Agent, or Firm*—Frank D. Gilliam; John R. Duncan

[57] ABSTRACT

A contra-rotating twin crankshaft system for internal combustion engines. Two crankshafts are arranged in parallel, and are connected together to rotate in opposite directions. At least one piston is spaced from the crankshafts. Connecting rod assemblies extend in a crossed relationship from each crankshaft to two spaced wristpins at the piston. Preferably, one connecting rod assembly is made up of two spaced connecting rods and the other is a single connecting rod which passes between the two spaced connecting rods to form the crossing relationship. If desired, the dual connecting rod assembly may be two spaced single connecting rods or have one connecting rod in the form of a fork, with the single connecting rod passing between the tines of the forked connecting rod.

11 Claims, 3 Drawing Sheets

CONTRA-ROTATING TWIN CRANKSHAFT INTERNAL COMBUSTION ENGINE

BACKGROUND OF THE INVENTION

This invention relates in general to crankshafts for internal combustion engines and, more specifically, to a system using two geared together, contra-rotating, crankshafts, connected to a piston through two crossed connecting rods each driven by one of the crankshafts.

In conventional internal combustion engines, each piston drives a single crankshaft through a single connecting rod extending between a wrist pin centrally located in the piston and a crankshaft pin. This arrangement is simple, light weight and has been brought to a high degree of development. However, this arrangement has problems with balance, noise and sidewall thrust on the piston resulting in undesirable friction. Consumers continue to demand smoother, more efficient, quieter engines. Automobile manufacturers have implemented engine balancing aids, primarily in the form of rotating balance shafts. Balance shafts are parasitic devices that improve balance but create durability problems, increased cost, complexity and weight as will as reduced engine efficiency. Off-center piston forces, noise and side thrust problems remain.

A number of different engines have been designed using two crankshafts with two spaced connecting rods connected to a single piston wrist pin to improve engine balance. Typical of these are the arrangement described by Powell in U.S. Pat. No. 1,433,649, Holman in U.S. Pat. No. 2,392,921 and Deland in U.S. Pat. No. 4,690,113. Very complex linkages are required to allow connection of two connecting rods to a single wrist pin and achieve the required linear piston movement. Torque between the two connecting rods may not be uniform and over-all engine balance is little improved.

Others have provided two crankshafts connected by two spaced connecting rods to two spaced wrist pins in attempts to provide more linear, balanced, piston movement. Typical of these are the arrangements described by Porter et al. in U.S. Pat. No. 810,347, Milano in Italian Patent No. 445,002 and Taga in Japanese Published Application No. 55-159947. Improved engine balance and reduced sidewall thrust are said to be achieved by this system. However, very close machining tolerances are required and these designs are sensitive to tolerance "stack up".

Mandella, in U.S. Pat. No. 5,211,065, describes an arrangement in which a complex assembly of connecting rods and linkages is provided between a single crankshaft and two spaced piston wristpins with the connecting rods crossed in order to achieve simple harmonic motion of the piston. This may improve cylinder axis balance but does nothing to overcome side-to-side balance and noise.

Thus, there is a continuing need for improvements in the relationship of crankshaft, connecting rods and pistons in internal combustion engines in order to improve balance, provide better torque, reduce sidewall thrust, reduce piston to cylinder friction and engine noise while reducing sensitivity to machining tolerances and tolerance stack-up.

SUMMARY OF THE INVENTION

The above-noted problems, and others, are overcome in accordance with this invention by a piston-to-crankshaft power transfer system for internal combustion engines which basically comprises first and second parallel crankshafts that are connected together in a contra-rotating relationship, the first and second crankshafts each connected to a separate, first and second, respectively, piston wristpin with first and second connecting rods which cross between corresponding crankshaft and wrist pin.

Any suitable connecting means may connect the two crankshafts to provide the desired rotation in opposite directions, such as gears, timing belts, chains or the like. Preferably, the first and second crankshafts are geared together to assure positive equal contra-rotation. The gears may be in the form of meshing single axial gears on each crankshaft.

The connecting rod means may have a single first connecting rod and a single second connecting rod spaced with the connecting rods spaced longitudinally along the length of the crankshafts to prevent interference. However, for best results, the first crankshaft means will consist of a pair of spaced connecting rods and the second connecting means will consist of a single connecting rod extending between the two first connecting rods in the required crossed relationship. This provides superior balance and piston stability. In a multi-cylinder engine, the crankshaft having the pair of connecting rods may alternate along the crankshaft, if desired.

Alternately, a first crankshaft means may use a forked connecting rod configuration, with a single first end connected to the crankshaft and a double second end formed from two generally parallel spaced tine members connected to the wrist pin. The second connecting rod means then would have a single, flattened, blade-like, configuration shaped to pass between the two spaced second ends of the forked connecting rod.

The additional crankshaft improves engine balance, eliminates piston side thrust and its associated friction and results in a unique engine geometry. The motion of the piston in this twin crankshaft arrangement is non-uniform, possessing expansion and compression strokes of differing length. The twin crankshaft configuration may typically have an expansion stroke length of 199 crank degrees and a compression stroke length of 161 crank degrees. This characteristic has benefits in providing improved cylinder filling with and air-fuel charge and an extended power stroke for a longer, more complete and cleaner burn. The twin crankshaft configuration is shorter overall than a conventional design. The twin crankshaft configuration typically may have a maximum piston height above the crank axis of 5.4 inches versus 6.14 inches for a conventional design of similar characteristics. This attribute makes the twin crankshaft design especially desirable for streamlined vehicles with low hoodlines.

Shaking forces are also significantly reduced with the twin crankshaft arrangement, in particular with one or two cylinder engines, and provides reduced rocking moments.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
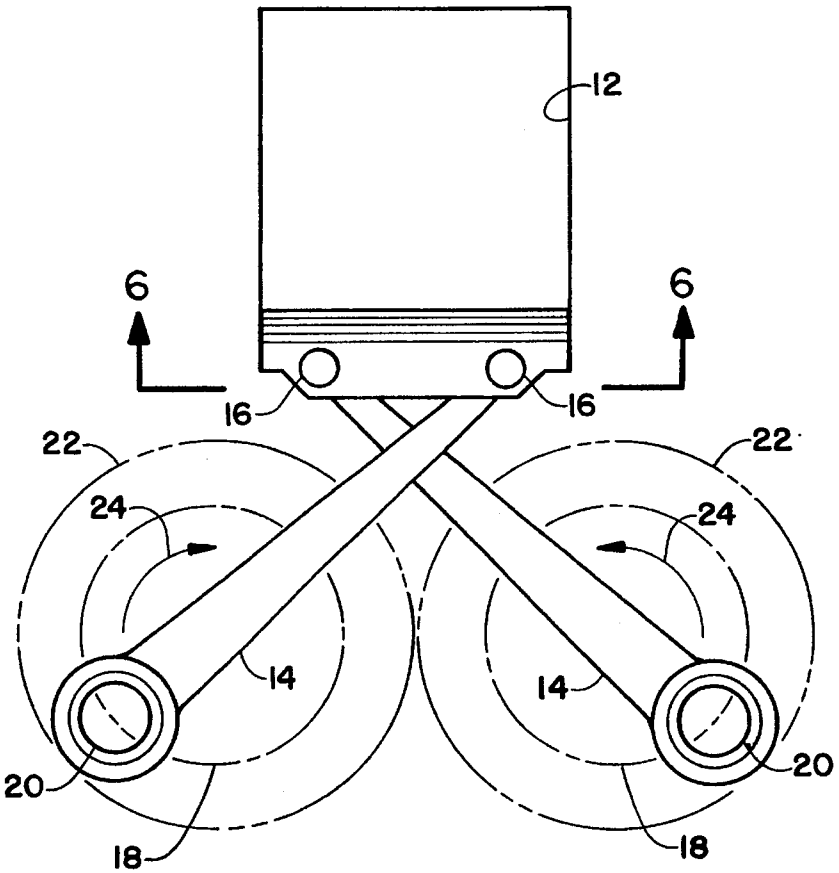
FIG. 1 is a schematic elevation view of the dual crankshaft arrangement at bottom dead center.

Referring to FIG. 1 there is seen a schematic representation of a piston 10 in a cylinder 12 with piston 10 at bottom dead center. A pair of connecting rods 14 are each connected to a piston wrist pin 16 at one end and to a crank pin 20 at the crankshaft 18 (schematically indicated by a circle) on the opposite side of the engine. Circles 18 further schematically indicate the paths along which the crank pins 20 move. Crankshafts are geared together by meshing gears 22 so as to contra-rotate as indicated by arrows 24. Thus, piston 10 can move smoothly up and down in cylinder 12 with forces evenly distributed across the piston and with the two crank shafts 18 and connecting rods 14 balanced.

Figure 2:
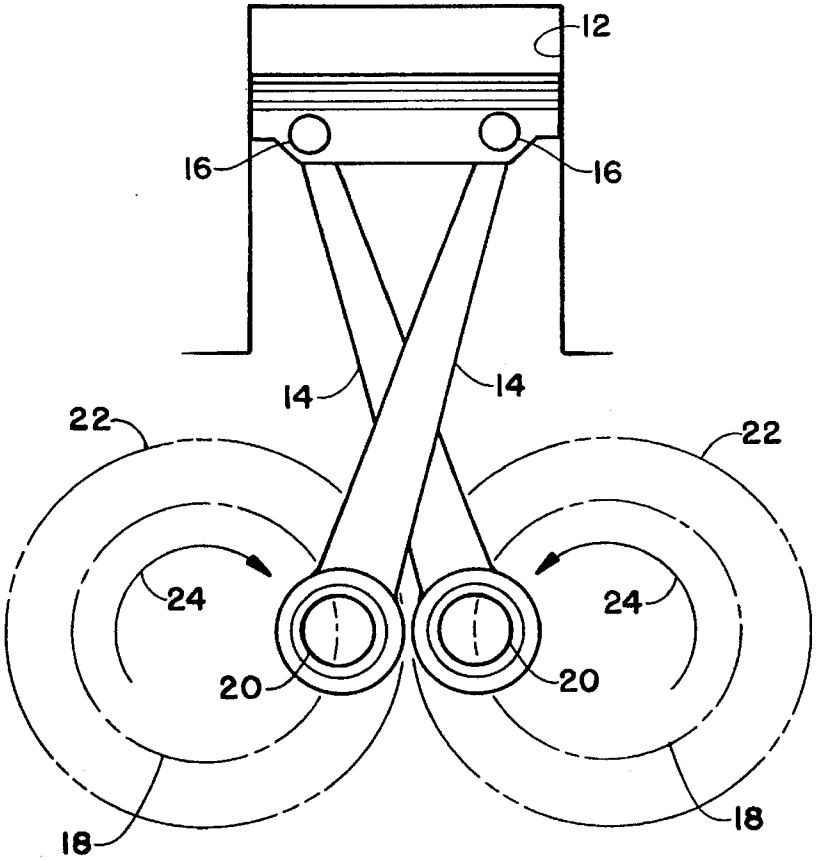
FIG. 2 is a schematic elevation view of the dual crankshaft arrangement at the point of closest connecting rod clearance.

FIG. 2 shows the apparatus of FIG. 1 with piston 10 at an intermediate position in cylinder 12, with connecting rods 14 at their closest point of approach. While a wider spacing could be provided, a close spacing is preferred for packaging considerations.

Figure 3:
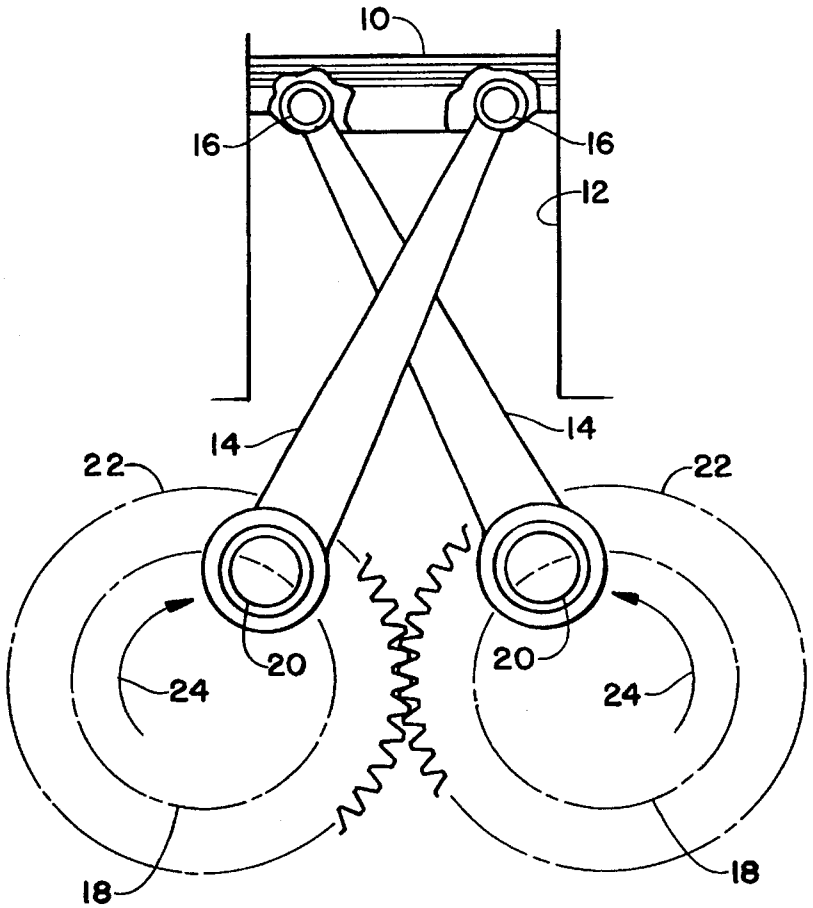
FIG. 3 is a schematic elevation view of the dual crankshaft arrangement at top dead center.

FIG. 3 shows the apparatus of FIG. 1 with piston 10 at the highest point, top dead center. As can be seen by comparing the positions of crank pins 20 in FIG. 1 (bottom dead center) with that shown in FIG. 3 (top dead center), the angular rotation of crankshafts 18 going from bottom dead center (FIG. 1) to top dead center (FIG. 3) is less than that from top dead center (FIG. 3) to bottom dead center (FIG. 1).

Figure 4:
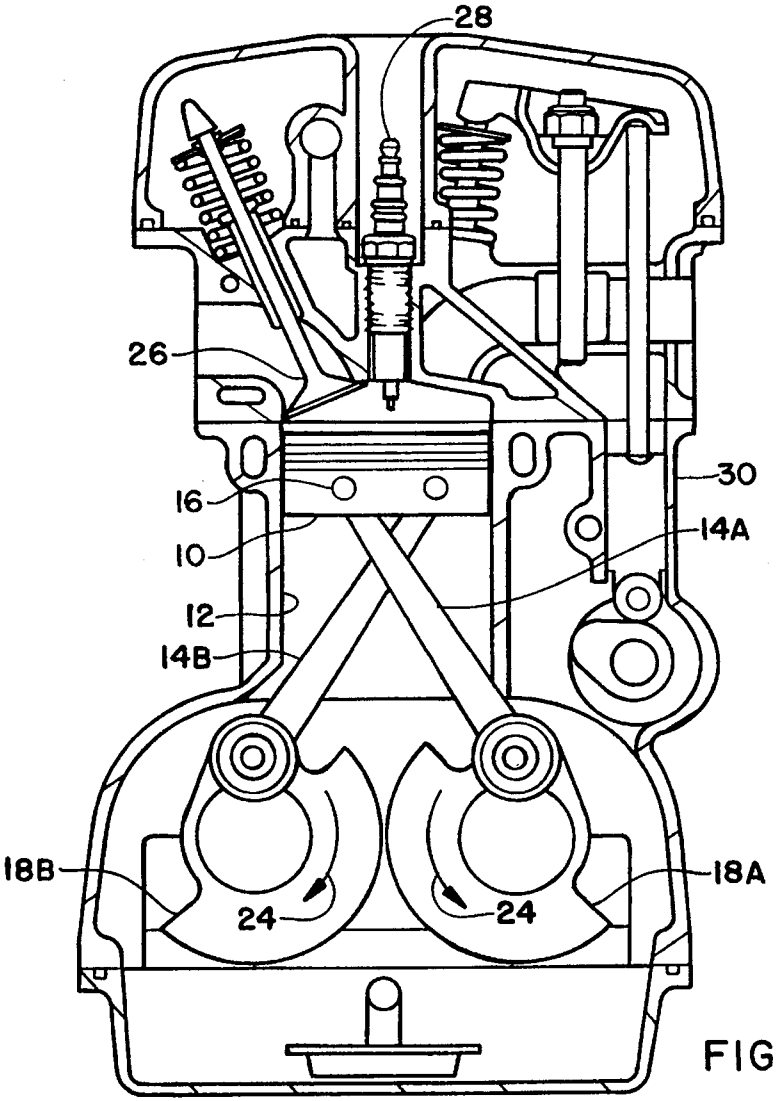
FIG. 4 is a partly cut-away front elevation view of an engine having the dual crankshaft arrangement.
Figure 5:
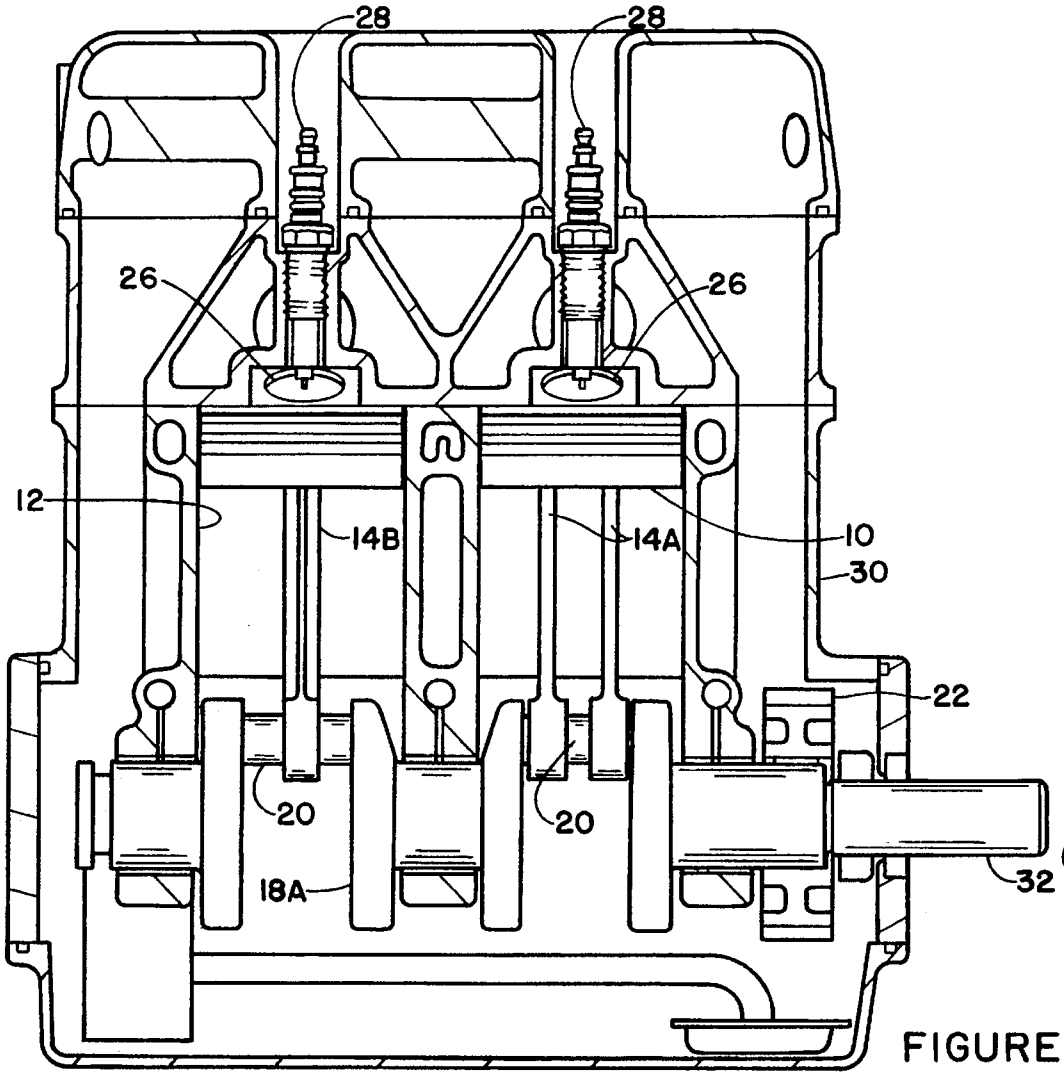
FIG. 5 is a partly cut-away side elevation view of an engine having the dual crankshaft arrangement.

FIGS. 4 and 5 are schematic representations (with the near side of the engine housing removed and components partially cut away to reveal selected internal components) of the front and side of a typical engine utilizing a preferred embodiment of the crankshaft system of this invention. The engine shown is a basically conventional, two-cylinder gasoline engine having valves 26, spark plugs 28, output shaft 32, etc., in an engine block 30.

In this embodiment, one crankshaft assembly consists of two geared together crankshafts 18A and 18B. The gears 22 between crankshafts 18A and 18B are not seen in FIG. 4, but are the same as in FIGS. 1–3. As seen in FIG. 4, one set of crankshafts 18A and 18B is connected to connecting rod assemblies 14A and 14B, respectively. The connecting rods are reversed at the second cylinder, and would preferably alternate along a 4, 6 or 8 cylinder engine.

Each connecting rod assembly 14A has two spaced connecting rods, with connecting rod 14B passing between them. In FIG. 5, only crankshaft 18B and the nearest connecting rods 14A (to the right) and 14B (to the left) are seen. This provides balanced forces on the crankshafts.

Figure 6:
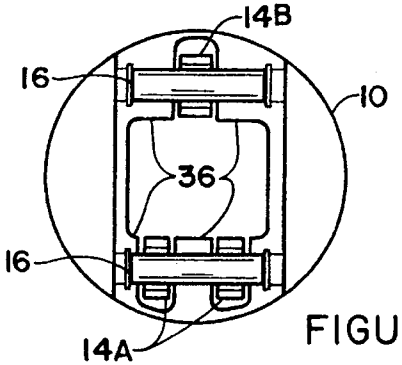
FIG. 6 is a detail section view of the piston bottom, taken on line 6—6 in FIG. 1.

The attachment of connecting rods 14A and 14B of FIGS. 4 and 5 to piston 10 is illustrated in FIG. 6. Each wrist pin 16 is secured in a transverse hole in webs 36 which extend downwardly from piston 10. Dual connecting rod 14A connects to one pin 16 and single connecting rod 14B connects to the other.

Figure 7:
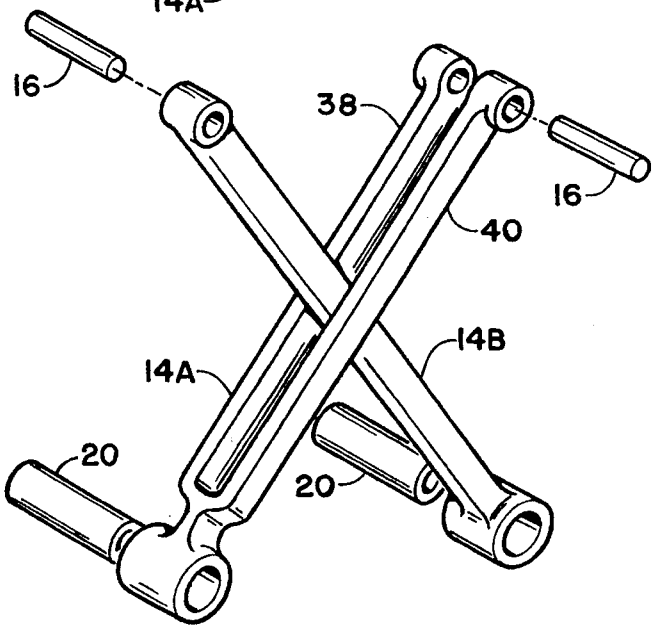
FIG. 7 is a detail perspective view of a forked connecting rod arrangement.

FIG. 7 is a detail perspective view of an alternate embodiment of dual connecting rod 14A. Here, connecting rod 14A is in the form of a fork, having two extending ends 38 and 40 between which connecting rod 14B extends.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A contra-rotating twin crankshaft system for internal combustion engines which comprises:

two substantially parallel first and second crankshafts;

drive means for causing said crankshafts to rotate substantially identically in opposite directions;

at least one piston spaced from said crankshafts;

first and second, substantially parallel, wrist pins secured to each said piston;

first and second connecting rod means extending between said first and second crankshafts and said first and second wrist pins, respectively, with said connecting rod means in a crossed relationship.

2. The contra-rotating twin crankshaft system according to claim 1 wherein each of said connecting rod means comprises a single elongated member fastened to one of said wrist pins and to a crank pin on one of said crankshafts.

3. The contra-rotating twin crankshaft system according to claim 1 wherein said drive means comprises a gear attached to each crankshaft for rotation about an axis of rotation of said crankshaft, said gears meshed to rotate together in opposite directions.

4. The contra-rotating twin crankshaft system according to claim 1 wherein said first connecting rod means consists of two spaced, substantially parallel rods and said second connecting rod means consists of a single rod arranged so that said second rod passes between said two first rods.

5. The contra-rotating twin crankshaft system according to claim 1 wherein said first connecting rod means has a forked configuration with a single first end connected to said first crankshaft and spaced second ends connected to a said wrist pin and said second connecting rod extends between said spaced second ends of said first connecting rod.

6. In an internal combustion engine having at least two cylinders, a piston movable in each said cylinder, crankshaft means spaced from each said piston, first and second, substantially parallel, wrist pins secured to each said piston and first and second connecting rod means extending from said respective wrist pins to said crankshaft means so that linear movement of each of said pistons is converted into rotary movement at said crankshaft means, the improvement comprising:

said crankshaft means comprising a pair of spaced substantially parallel first and second crankshafts;

means for coupling said crankshafts together for rotation in opposite directions; and said first and second connecting rod means extending from each of said respective first and second crankshafts to said first and second wrist pins, respectively, with said first and second connecting rod means in a crossed relationship.

7. The improvement according to claim 6 wherein said coupling means includes a gear means secured to each said crankshaft with said gear means meshed together.

8. The improvement according to claim 6 wherein each of said first and second connecting rod means is a single elongated member connected between a crankshaft and a said wrist pin with said elongated members spaced closely adjacent to each other.

9. The improvement according to claim 6 wherein said first connecting rod means comprises two parallel spaced elongated members and said second connecting rod means comprises a single elongated member positioned between said two parallel spaced elongated members.

10. The improvement according to claim 6 wherein said first connecting rod means has a forked configuration with a single first end connected to said first crankshaft and spaced second ends connected to a said wrist pin and said second connecting rod means is a single elongated member extending between said spaced second ends of said first connecting rod.

11. The improvement according to claim 10 wherein said second connecting rod means has a flattened, blade-like configuration.

* * * * *